US010252121B2

(12) United States Patent
Fossum et al.

(10) Patent No.: US 10,252,121 B2
(45) **Date of Patent: *Apr. 9, 2019**

(54) GOLF CLUB HEADS WITH FACE DEFLECTION STRUCTURES AND RELATED METHODS

(71) Applicant: KARSTEN MANUFACTURING CORPORATION, Phoenix, AZ (US)

(72) Inventors: Brandon L. Fossum, Phoenix, AZ (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/650,440

(22) Filed: Jul. 14, 2017

(65) Prior Publication Data

US 2017/0312594 A1 Nov. 2, 2017

Related U.S. Application Data

(63) Continuation of application No. 14/454,574, filed on Aug. 7, 2014, now Pat. No. 9,770,633.

(60) Provisional application No. 61/863,890, filed on Aug. 8, 2013.

(51) Int. Cl.
*A63B 53/04* (2015.01)

(52) U.S. Cl.
CPC ..... *A63B 53/0466* (2013.01); *A63B 53/04* (2013.01); *A63B 2053/0408* (2013.01); *A63B 2053/0433* (2013.01)

(58) Field of Classification Search
CPC ..... A63B 53/0466; A63B 53/04; A63B 2053/0433; A63B 2053/0408
See application file for complete search history.

(56) References Cited

U.S. PATENT DOCUMENTS

| | | | |
|---|---|---|---|
| 5,380,009 | A | 1/1995 | Henry et al. |
| D366,682 | S | 1/1996 | Antonious |
| 5,632,695 | A | 5/1997 | Hlinka et al. |
| 5,762,567 | A | 6/1998 | Antonious |
| RE35,955 | E | 11/1998 | Luv |
| 6,348,013 | B1 | 2/2002 | Kosmatka |
| 6,530,847 | B1 | 3/2003 | Antonious |
| D482,420 | S | 11/2003 | Burrows |
| 7,294,064 | B2 | 11/2007 | Tsurumaki et al. |
| 7,500,924 | B2 | 3/2009 | Yokota |
| 8,083,612 | B2 | 12/2011 | Stites et al. |
| 8,235,841 | B2 | 8/2012 | Stites et al. |
| 8,235,844 | B2 | 8/2012 | Albertsen et al. |
| 8,403,771 | B1 | 3/2013 | Rice et al. |
| 8,435,134 | B2 | 5/2013 | Tang et al. |
| 8,529,368 | B2 | 9/2013 | Rice et al. |
| D692,077 | S | 10/2013 | Greensmith et al. |
| 8,591,351 | B2 | 11/2013 | Albertsen et al. |
| 8,641,555 | B2 | 2/2014 | Stites et al. |
| 8,721,471 | B2 | 5/2014 | Albertsen et al. |
| 8,821,312 | B2 | 9/2014 | Burnett et al. |
| 8,834,289 | B2 | 9/2014 | De La Cruz et al. |
| 8,834,290 | B2 | 9/2014 | Bezilla et al. |
| 8,900,069 | B2 | 12/2014 | Beach et al. |

(Continued)

*Primary Examiner* — Stephen Blau

(57) ABSTRACT

Embodiments of golf club heads with face deflection structures are described herein. Other examples and related methods are also disclosed herein.

20 Claims, 4 Drawing Sheets

(56) References Cited

U.S. PATENT DOCUMENTS

| | | | | |
|---|---|---|---|---|
| 8,956,242 | B2 | 2/2015 | Rice et al. | |
| 8,961,332 | B2 | 2/2015 | Galvan et al. | |
| 8,986,133 | B2 | 3/2015 | Bennett et al. | |
| 9,211,448 | B2 | 12/2015 | Bezilla et al. | |
| 9,220,953 | B2 | 12/2015 | Beach et al. | |
| 9,320,949 | B2 | 4/2016 | Golden et al. | |
| 2002/0183134 | A1 | 12/2002 | Allen et al. | |
| 2004/0192463 | A1 | 9/2004 | Tsurumaki et al. | |
| 2007/0026961 | A1 | 2/2007 | Hou | |
| 2007/0049416 | A1 | 3/2007 | Shear | |
| 2012/0142447 | A1 | 6/2012 | Boyd et al. | |
| 2012/0142452 | A1* | 6/2012 | Burnett ..... | A63B 53/0466 473/345 |

* cited by examiner 1931
1100
150
1600
4000
1610
4630
1650
2552
2540
2555
2500
2508
2200
1550
2507
1556
1551
2509
1210
1255
1820
2510
2501
2551
2503
2504
2520
1810
1555
4710
2560
2570
2502
1200
2515
2550
4720
2525

GOLF CLUB HEADS WITH FACE DEFLECTION STRUCTURES AND RELATED METHODS

CROSS-REFERENCE TO RELATED APPLICATIONS

This is a continuation of U.S. patent application Ser. No. 14/454,574, filed on Aug. 7, 2014, which claims priority to U.S. Provisional Patent Application No. 61/863,890, filed on Aug. 8, 2013, the contents of all of which are incorporated fully herein by reference in their entirety.

TECHNICAL FIELD

The present disclosure generally relates to golf equipment and, more particularly, to golf club heads with face deflection structures.

BACKGROUND

Golf clubs and specifically golf club heads of various designs have typically been developed to improve a person's golf swing and resulting golf shot. In particular, many people are unable to hit or lack consistency when hitting "down" on a ball, that is, to regularly hit the ball squarely. Golf club designs and, particularly, golf club head designs may optimize a golf club head's impact on the golf ball, such that the golf club head can impart better flight characteristics to the golf ball, such as increased launch angle, increased speed, and/or decreased ball spin. Such designs may mitigate a person's inconsistency problems.

Figure 1:
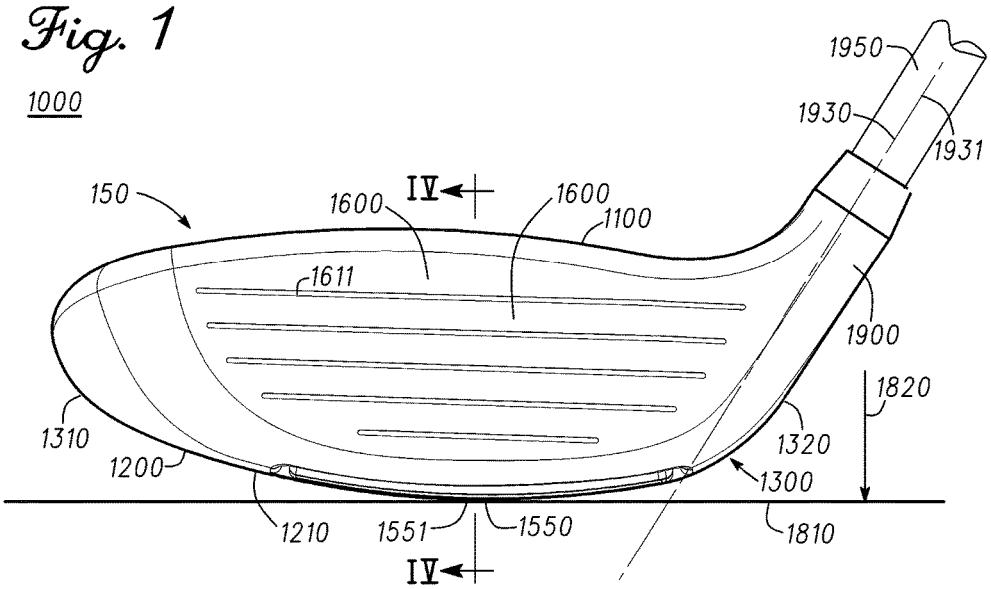
FIG. 1 illustrates a front view of a golf club head at address according to an embodiment.

For simplicity and clarity of illustration, the drawing figures illustrate the general manner of construction, and descriptions and details of well-known features and techniques may be omitted to avoid unnecessarily obscuring the disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the disclosure described herein are, for example, capable of operation in other orientations than those illustrated or otherwise described herein.

The terms "couple," "coupled," "couples," "coupling," and the like should be broadly understood and refer to connecting two or more elements mechanically and/or otherwise. Two or more mechanical elements may be mechanically coupled together, but not be electrically or otherwise coupled together. Coupling may be for any length of time, e.g., permanent or semi permanent or only for an instant.

"Electrical coupling" and the like should be broadly understood and include coupling involving any electrical signal, whether a power signal, a data signal, and/or other types or combinations of electrical signals. "Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION

In one embodiment of the golf club heads with face deflection structures and related methods, a golf club head comprises a crown, a sole, a head front end, a head rear end, a shaft axis defining a shaft axis plane, and at least one of a hosel, a toe skirt, or a heel skirt. The embodiment can further comprise a head wave section proximate the head front end and comprising part of at least one of the crown, the sole, the toe skirt, or the heel skirt, and a deflector at the head wave section. In some embodiments, with the golf club head at address over a ground plane, the shaft axis plane can be orthogonal to the ground plane and the head front end comprises a strikeplate and a leading edge. In addition, the deflector comprises a deflector front edge adjacent to the head front end, a deflector rear edge opposite the deflector front edge, and a wave surface extended from the deflector front edge to the deflector rear edge and comprising a wavelength measured in a front-rear direction with respect to the head front end and the head rear end. A leading edge vertical plane intersects the leading edge and is parallel to the shaft axis plane, and a deflector front plane intersects the deflector front edge and is parallel to the shaft axis plane. Further, the strikeplate comprises a strikeplate thickness, and a deflector front offset, measured from the leading edge vertical plane to the deflector front plane and orthogonal to the shaft axis plane, is less than three times the strikeplate thickness.

In some embodiments of the golf club heads with face deflection structures and related methods, a method comprises providing a head body of a golf club head, the head body comprising a crown, a sole, a head front end, a head rear end, a shaft axis defining a shaft axis plane, at least one of a hosel, a toe skirt, or a heel skirt, and a head wave section proximate the head front end and comprising part of at least one of the crown, the sole, the toe skirt, or the heel skirt, and providing a deflector at the head wave section. The method may further comprise that, with the golf club at address over a ground plane the shaft axis is orthogonal to the ground plane and the head front end comprises a strikeplate and a leading edge. The deflector comprises a deflector front edge adjacent to the head front end, a deflector rear edge opposite the deflector front edge, and a wave surface extended from the deflector front edge to the deflector rear edge and comprising a wavelength measured in a front-rear direction with respect to the head front end and the head rear end. Further, a leading edge vertical plane intersects the leading edge and is parallel to the shaft axis plane, a deflector front plane intersects the deflector front edge and is parallel to the shaft axis plane, the strikeplate comprises a strikeplate thickness, and a deflector front offset, measured from the leading edge vertical plane to the deflector front plane and orthogonal to the shaft axis plane, is less than three times the strikeplate thickness.

Examples and embodiments are disclosed herein. Such examples and embodiments may be found in the figures, in the claims, and/or in the present description.

Figure 2:
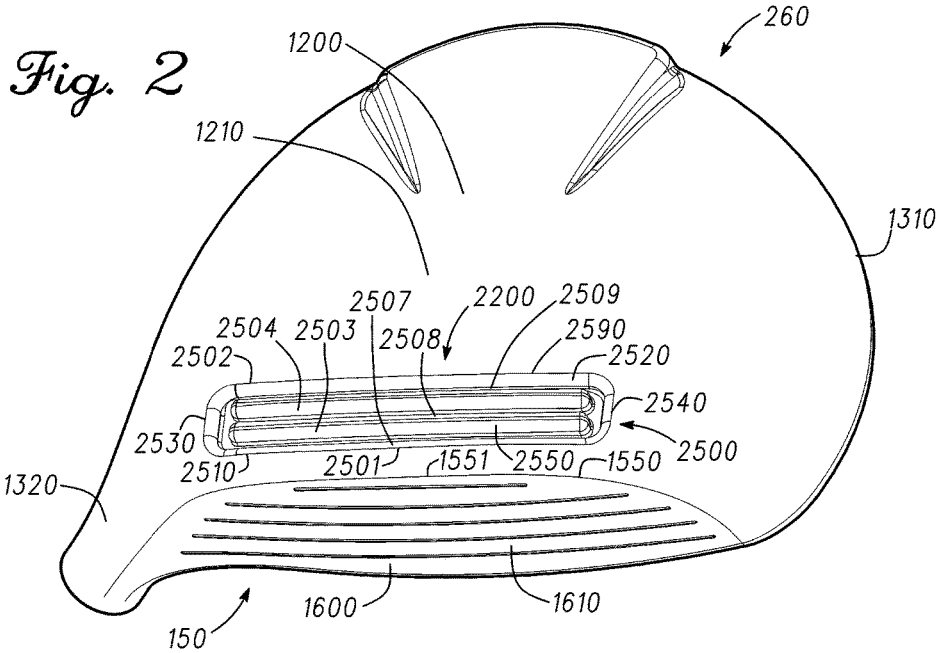
FIG. 2 illustrates a side bottom and front view of the golf club head of FIG. 1.
Figure 3:
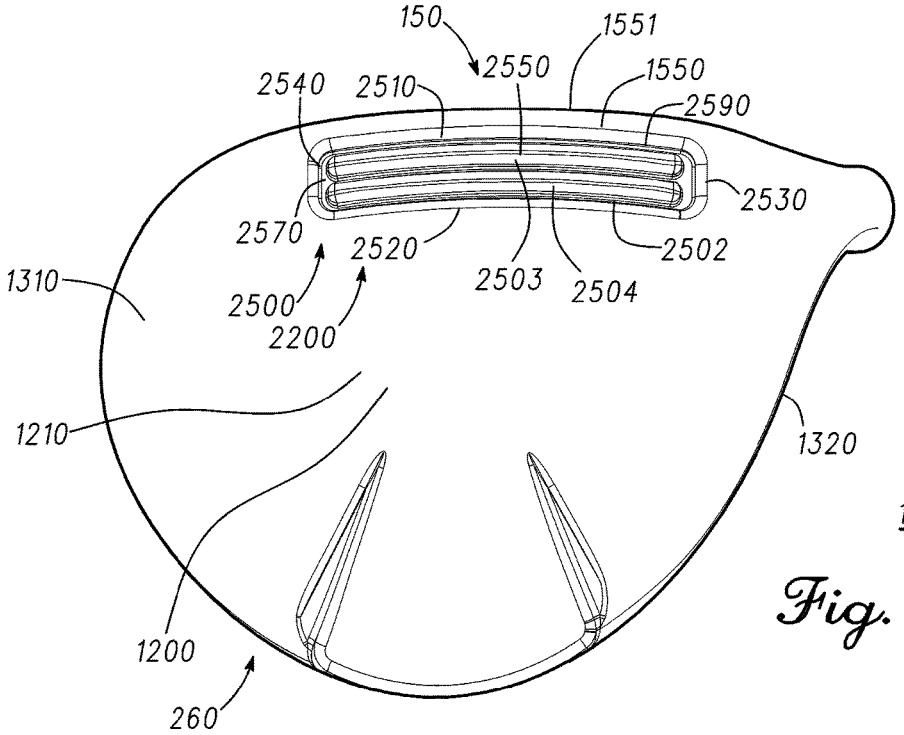
FIG. 3 illustrates a bottom view of the golf club head of FIG. 1.
Figure 4:
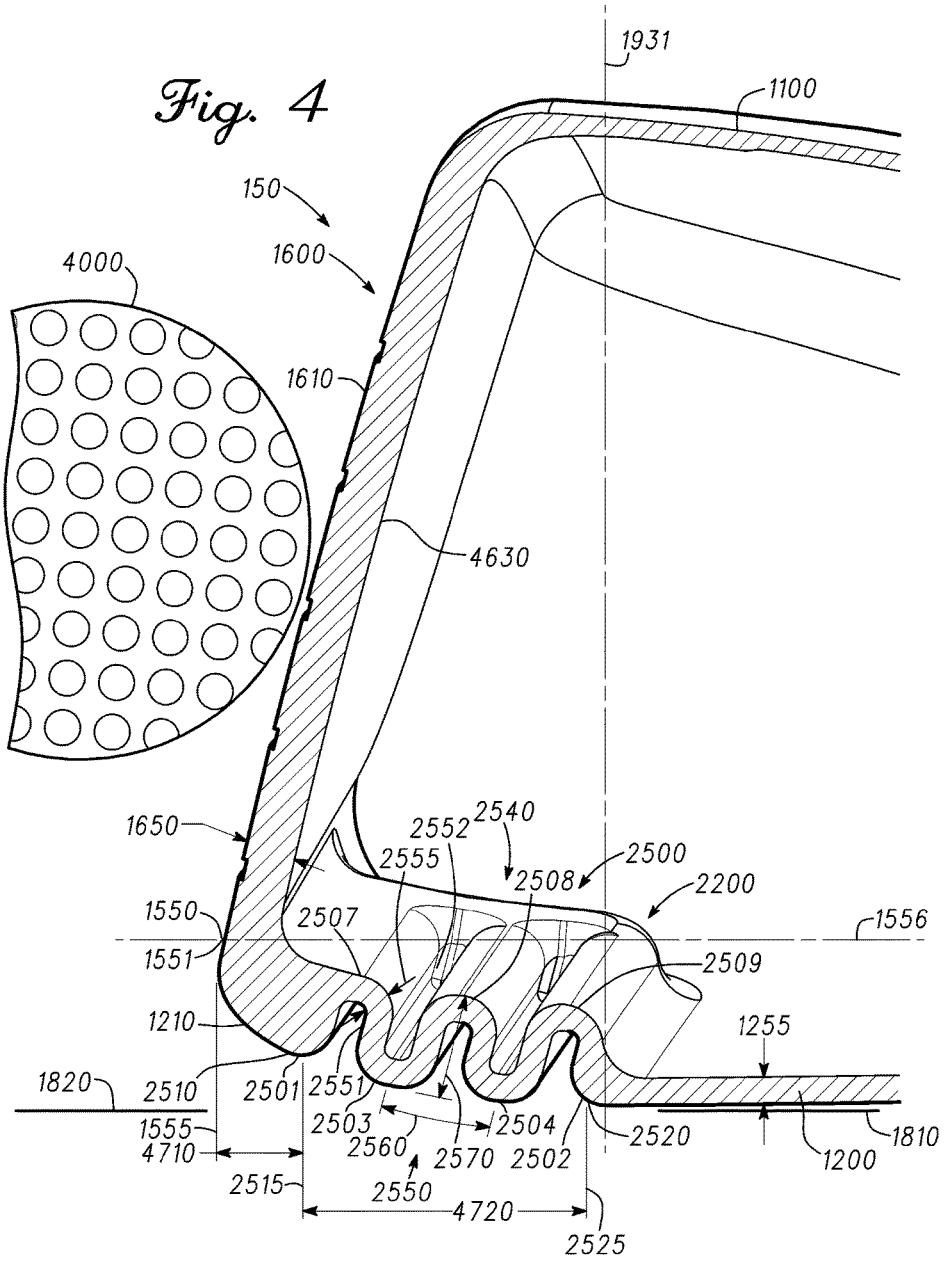
FIG. 4 illustrates a side cross-sectional view of the golf club head with respect to line IV-IV of FIG. 1.

FIG. 1 illustrates a front address view of golf club head 1000. FIG. 2 illustrates a bottom and front view of golf club head 1000. FIG. 3 illustrates a bottom view of golf club head 1000. FIG. 4 illustrates a side cross-sectional view of golf club head 1000 and with respect to line IV-IV of FIG. 1.

As shown in FIGS. 1-4, golf club head 1000 can be a metalwood golf club head with a unique face-to-sole transition. The face-to-sole transition can be constructed comprising thin wave structures that are designed to compress upon impact with a golf ball. The wave spring structures reduce the sole stiffness in the direction parallel to the ball impact. This reduced stiffness leads to increased face deflection. Increasing face deflection increases ball speed through a more efficient energy transfer from club to ball.

Golf club head 1000 comprises crown 1100, sole 1200, head rear end 260, and head front end 150 with strikeplate 1600. In the present example, golf club head 1000 also comprises skirt 1300 with toe skirt 1310 and heel skirt 1320. Also in the present example, golf club head 1000 comprises hosel 1900 configured to receive shaft 1950, where shaft axis 1930 extends along a longitudinal centerline of shaft 1950 and/or or hosel 1900.

Strikeplate 1600 comprises strikeface 1610, and is coupled to golf club head 1000 at head front end 150. Golf club head 1000 also comprises head wave section 2200 with deflector 2500 coupled thereto, where deflector 2500 is configured to permit or increase deflection of strikeplate 1600 upon ball impact with golf ball 4000 (FIG. 4). In some embodiments, such deflection afforded by deflector 2500 can influence ball launch characteristics of golf ball 4000 based on where the ball impact occurs at strikeface 1610.

Head wave section 2200 is proximate to head front end 150, and can be located alongside part of at least one of crown 1100, sole 1200, toe skirt 1310, or heel skirt 1320. For instance, the embodiment of FIGS. 1-4 shows head wave section 2200, with deflector 2500, alongside part of sole 1200, toe skirt 1310, and heel skirt 1320. There can be other embodiments where wave section 2200 and deflector 2500 can be at other locations, such as (a) only at sole 1200, (b) only at toe skirt 1310, (c) only at heel skirt 1320, (d) only at sole 1200 and toe skirt 1310, (e) only at sole 1200 and heel skirt 1320, or (e) at crown 1100.

Deflector 2500 is shown in FIGS. 2-4 as integral with head wave section 2200, but there can be embodiments where deflector 2500 and head wave section 2200 can comprise different pieces coupled together, such as via welding or brazing.

As shown in FIGS. 1 and 4, golf club head 1000 is shown at address with respect to ground plane 1810, which is orthogonal to gravity vector 1820. Shaft axis 1930 defines and extends along shaft axis plane 1931, where shaft axis plane 1931 is orthogonal to ground plane 1810 when golf club head 1000 is at address as shown in FIGS. 1 and 4. In addition, when golf club head 1000 is at address, grooves 1611 of strikeface 1610 can be parallel to ground plane 1810. Head front end 150 of golf club head 1000 also comprises leading edge 1550, defining a forwardmost edge having forwardmost point 1551 of golf club head 1000 when at address.

Deflector 2500 comprises deflector front edge 2510 adjacent to head front end 150, and deflector rear edge 2520 opposite deflector front edge 2510. Deflector 2500 also comprises wave surface 2550 extended from deflector front edge 2510 to deflector rear edge 2520. In some embodiments, deflector front edge 2510 can be defined by external wave through 2501, which is the frontmost external wave trough of wave surface 2550 in the present example. Similarly, deflector rear edge 2520 can be defined by rearmost external wave trough 2502, which is the rearmost external wave trough of wave surface 2550 in the present example. Wave surface 2550 also comprises wavelength 2560 which, as seen in FIG. 4, can be measured between consecutive external wave troughs 2503 and 2504 thereof in a front-rear direction with respect to head front end 150 and head rear end 260 and that can be substantially orthogonal to shaft axis plane 1931. In some examples, wavelength 2560 can be approximately 2.5 millimeters (mm) to approximately 5 mm. In the same or other examples, wavelength 2560 can also exist between external wave troughs 2501 and 2503 and between 2504 and 2502.

In the present example wave surface 2550 comprises a substantially sinusoidal wave shape. There can be other embodiments where wave surface 2550 can comprise a different wave shape, such as a substantially sawtooth wave shape, a substantially triangular wave shape, or a substantially square wave shape. In addition, there can be embodiments where wave surface 2550 need not be fully periodic, such that its ripples, crests, or troughs need not be evenly spread from each other.

Head front end 150 of golf club head 1000 comprises strikeplate 1600 with strikeplate thickness 1650. In some examples, strikeplate thickness 1650 can comprise a maximum thickness of strikeplate 1600, measured from strikeface 1610 to backface 4630. In the same or other examples, strikeplate thickness 1650 can be measured at a center of strikeplate 1600, or proximate to deflector 2500.

The inclusion of deflector 2500 permits strikeplate 1600 to deflect towards the interior of golf club head 1000 and then towards the front of golf club head 1000 during impact with golf ball 4000, thereby dissipating impact stresses that would otherwise be absorbed by strikeplate 1600. Such a feature permits strikeplate thickness 1650 to be reduced or minimized without compromising structural integrity thereof, thus reducing the amount of mass required for strikeplate 1600, where such mass can be relocated or removed to thereby adjust golf club characteristics and improve golf shot performance. For instance, the deflection of strikeplate 1600 permitted by deflector 2500 can improve a launch angle of golf ball 4000, and/or can reduce a ball spin thereof for improved flight characteristics.

To improve the dissipation of impact stresses by deflector 2500, and/or to augment the deflection of strikeplate 1600, deflector 2500 can be located as close as practical to head front end 150 and/or to leading edge 1550 of golf club head 1000 to be more directly exposed to such impact stresses. Accordingly, in some implementations, deflector 2500 can comprise deflector front offset 4710, which can be less than three times strikeplate thickness 1650 such as to increase the exposure of deflector 2500 to the impact stresses associated with impact with golf ball 4000. In the present example, deflector front offset 4710 is measured from leading edge vertical plane 1555 to deflector front plane 2515 and is measured substantially orthogonal to shaft axis plane 1931. Leading edge vertical plane 1555 intersects leading edge 1550 at forwardmost point 1551 and is substantially parallel to shaft axis plane 1931, and deflector front plane 2515 intersects deflector front edge 2510 and is substantially parallel to shaft axis plane 1931.

Deflector 2500 can be implemented in different kinds of golf club heads to provide corresponding deflection benefits. For instance, for fairway-wood-type or hybrid-type golf club head examples, deflector 2500 can be located such that deflector front offset 4710 can be up to approximately 7.65 mm, and can permit strikeplate 1600 to be thinner such that strikeplate thickness 1650 can be approximately 1.2 mm to approximately 2.5 mm. As another example, for driver-type golf club head embodiments, deflector 2500 can be located such that deflector front offset 4710 can be up to approximately 13.5 mm, and can permit strikeplate 1600 to be thinner such that strikeplate thickness 1650 can be approximately 1.9 mm to approximately 4.4 mm.

Deflector 2500 also comprises deflector depth 4720 measured from deflector front plane 2515 to deflector rear plane 2525 and is measured substantially orthogonal to shaft axis plane 1931, where deflector rear plane 2525 intersects deflector rear edge 2520 and is substantially parallel to shaft axis plane 1931. Deflector depth 4720 can be less than approximately 12.5 mm in some implementations. Deflector 2500 also can have a deflector length from heel to toe of less than approximately 6.4 centimeters (cm).

In the present example, deflector front edge 2510 of deflector 2500 is located forward of shaft axis plane 1931, considering the benefits of placing deflector 2500 closer to head front end 150 as described above. For similar reasons, deflector 2500 is located between leading edge 1550 and shaft axis plane 1931 such that deflector rear edge 2520 is located forward of shaft axis plane 1931. There can be examples where a majority of deflector rear edge 2520 is located forward of shaft axis plane 1931.

As seen in FIG. 4, wave surface 2550 of deflector 2500 comprises wave crests 2507, 2508, and 2509 at the interior of golf club head 1000. Deflector 2500 is configured so as not to unduly protrude into the interior of golf club head 1000, thus limiting the mass of deflector 2500 and any effects on the location of the center of gravity of golf club head 1000. In the present example, golf club head 1000 comprises leading edge horizontal plane 1556 intersecting leading edge 1550 at forwardmost point 1551 and orthogonal to shaft axis plane 1931. Considering the desire to limit the protrusion of deflector 2500 into golf club head 1000 as described above, each of wave crests 2507, 2508, and 2509 is located below leading edge horizontal plane 1556 in the present example. There can also be examples where, for instance, wave crest 2507 is not located below leading edge horizontal plane 1556, but where at least one of wave crest 2508 or 2509 is located below leading edge horizontal plane 1556. In addition, in the present embodiment, wave surface 2550 comprises wave height 2570, which is measured from inner wave side 2552 of internal wave crest 2508 to a substantially orthogonal intersection with wavelength 2560 measured along portions of outer wave side 2551. Wave height 2570 can be approximately 2.5 mm to approximately 5.1 mm in some examples.

As seen in FIGS. 2-4, head wave section 2200 and deflector 2500 coupled thereto are located at sole 1200. Golf club head 1000 also comprises underside contour silhouette 1210 defined by at least one of sole 1200, toe skirt 1310, or heel skirt 1320. Underside contour silhouette extends across deflector 2500 to head front end 150. In the present embodiment, external wave troughs 2501, 2502, 2503, and 2504 extend to reach underside contour silhouette 1210 such that deflector 2500 follows the outline dictated by underside contour silhouette 1210. There can be other embodiments as well where at least one or at least part of one of external wave troughs 2501, 2502, 2503, and 2504 does not extend to reach underside contour silhouette 1210.

As seen in FIG. 4, wave surface 2550 comprises inner wave side 2552 facing the interior of golf club head 1000, and outer wave side 2551 facing the exterior of golf club head 1000. Wave surface 2550 also comprises wave surface thickness 2555 measured along a minimum distance from inner wave side 2552 to outer wave side 2551. In some examples, wave surface thickness 2555 can be approximately 0.5 mm to approximately 2 mm. In the same or other examples, wave surface thickness 2555 can be thinner than sole thickness 1255 of sole 1200. Sole thickness 1255 can comprise, for example, a minimum thickness of sole 1200.

Deflector 2500 is configured in the present embodiment such that deflector front edge 2510 is longer than deflector rear edge 2520. In particular, deflector 2500 is bounded by deflector perimeter 2590, which comprises deflector front edge 2510, deflector rear edge 2520, deflector heel edge 2530, and deflector toe edge 2540, and where deflector perimeter 2590 is substantially trapezoidal with a largest dimension thereof facing towards head front end 150 of golf club head 1000. In other examples, however, deflector perimeter 2590 can comprise other shapes, such as a substantially rectangular shape, a substantially semicircular shape, a substantially elliptical shape, or a substantially semi-elliptical shape.

As can be seen in FIGS. 2-3, external wave troughs 2503 and 2504 end short of deflector heel edge 2530 and deflector toe edge 2540, departing from underside contour silhouette 1210 thereat towards the interior of golf club head 1000. In a different embodiment, one or both of external wave troughs 2503 or 2504 can extend to reach head wave section 2200 at deflector heel edge 2530 and/or at deflector toe edge 2540 along sole contour silhouette 1210. Other embodiments can differ with respect to such features.

Figure 5:
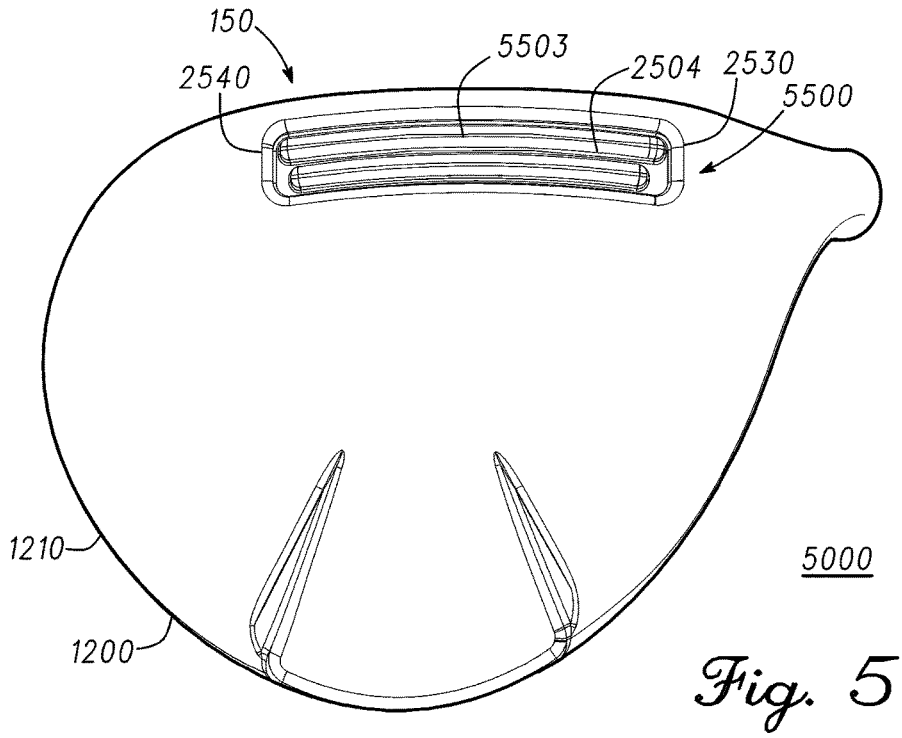
FIG. 5 illustrates a bottom view of a golf club head according to another embodiment.

For instance, FIG. 5 illustrates an underside view of golf club head 5000, which is similar to golf club head 1000, but comprises deflection junction 5500. Deflection junction 5500 is similar to deflection junction 2500 (FIGS. 2-4), but comprises external wave troughs 5503 and 2504 (FIG. 5). External wave trough 2504 was discussed above with respect to deflection junction 2500 (FIGS. 2-4), and external wave trough 5503 (FIG. 5) is similar to external wave trough 2503 (FIGS. 2-4), but extends to reach deflector heel edge 2530 and deflector toe edge 2540 along sole contour silhouette 1210.

Figure 6:
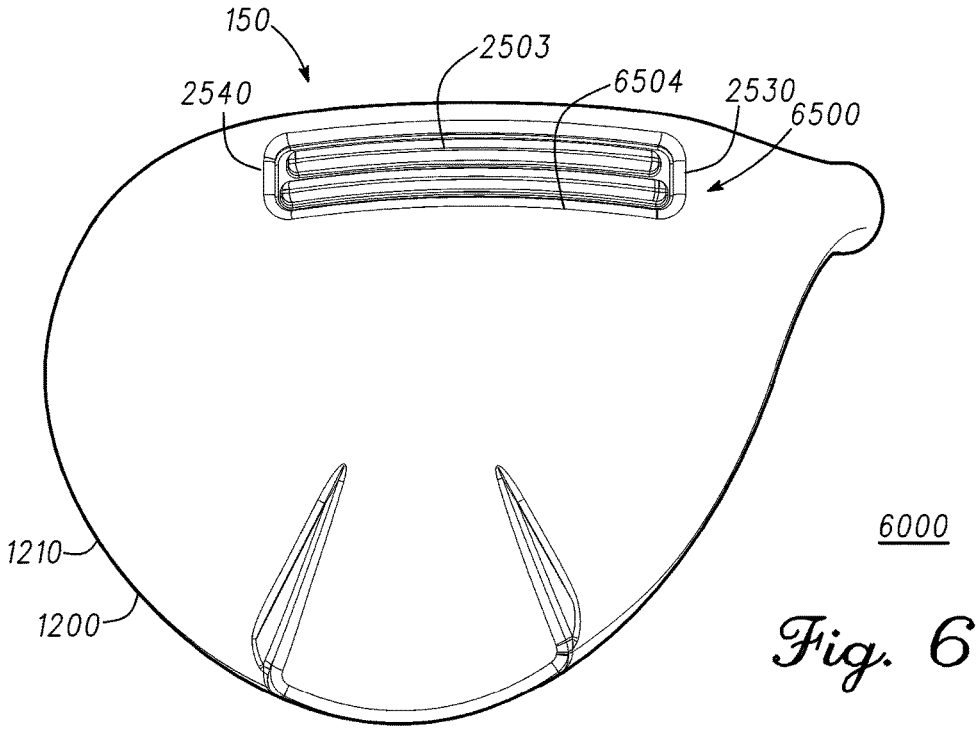
FIG. 6 illustrates a bottom view of a golf club head according to another embodiment.

As another example, FIG. 6 illustrates an underside view of golf club head 6000, which is similar to golf club head 1000 but comprises deflection junction 6500. Deflection junction 6500 is similar to deflection junction 2500 (FIGS. 2-4), but comprises external wave troughs 2503 and 6504 (FIG. 6). External wave trough 2503 was discussed above with respect to deflection junction 2500 (FIGS. 2-4), and external wave trough 6504 (FIG. 6) is similar to external wave trough 2504 (FIGS. 2-4) but extends to reach deflector heel edge 2530 and deflector toe edge 2540 along sole contour silhouette 1210.

By using multiple low amplitude waves, the performance, mass distribution, and durability of the golf club can be optimized. Each dimension influences the wave structure performance in a unique way. Deflector front offset 4710 can influence the durability of the club head and the force transfer from ball impact. Wave height 2570 can influence the deformation at ball contact by wave structure compression (parallel with the direction of the ball travel). Deflector depth 4720 can influence the deformation at ball contact because it determines the torque formed about the toe-side and heel-side end points of the wave structures.

In some embodiments, these three dimensions can be optimized for performance and durability by staying proportional to one another: the smaller in magnitude deflector front offset 4710 is, the smaller in magnitude wave height 2570 can be, and the smaller deflector depth 4720 can be. In some embodiments. an advantage can be gained when wave height 2570 is minimized to keep the mass low in the club head, the durability of the club head remains, and the wave structures properly deflect at ball contact. The smaller front offset 4710 gets, the lower wave height 2570 can be made. However, there can be a value of front offset 4710 wherein the durability drops off, and there can be a threshold value for wave height 2570 wherein the wave structures no longer compress in the desired way.

Deflector depth 4720 contributes to the wave structure deformation by providing a moment arm from the point of contact with the golf ball (where the face deforms at contact with a golf ball), to the two ends of the wave structures. When deflector depth 4720 is increased, so is the moment arm, and consequently, the amount of torque applied at the ends of the wave structures is increased. The increased torque from the longer moment arm can cause the wave structures to deform more severely about the two ends of the wave structures. A greater torque about the anchor point can cause greater deformation of the wave structures.

An advantage of not extending the sole feature vertically is that it is created with less mass and that the mass used is lower on the club head. By using less mass to create the feature, it allows for more discretionary mass to be placed further back in the club head to promote better launch conditions and increased moment of inertia (MOI). By keeping the mass that is used low, it promotes better launch conditions through reduced spin and a more efficient impact to increase ball speed.

Shots struck low on the face of a typical metalwood have increased spin caused by gear affect. This sole feature concept can increase the ratio of lower-to-upper face deflection, which can create a top spin gear affect. This top spin gear affect can counteract the gear affect of the head, leading to reduced spin on shots struck low on the face versus a metalwood without this structure.

Figure 7:
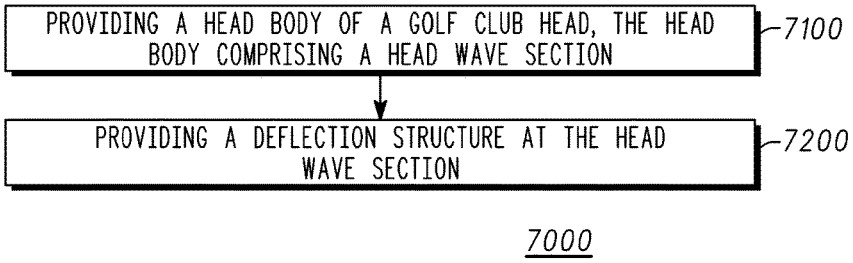
FIG. 7 illustrates a flowchart for a method of providing a golf club head in accordance with the present disclosure and the different embodiments described herein.

Continuing to FIG. 7, a flowchart is presented therein for a method of providing a golf club head in accordance with the present disclosure. In some examples, the golf club head can be similar to one or more of the golf club heads discussed above with respect to FIG. 6 or variations thereof.

Block 7100 of method 7000 involves providing a head body of the golf club head, where the head body comprises a head wave section. In some examples, the head body can be similar to the head body described above for FIGS. 1-6 as formed by crown 1100, sole 1200, head rear end 260, head front end 150, strikeplate 1600, toe skirt 1310 and/or heel skirt 1320. In the same or other examples, the head wave section can be similar to head wave section 2200 as also described above with respect to FIGS. 1-6.

Block 7200 of method 7000 comprises providing a deflection structure at the head wave section of the head body. In some examples, the deflection structure can be similar to deflector 2500 (FIGS. 2-4), deflector 5500 (FIG. 5), deflector 6500 (FIG. 6), or to variations thereof as described above.

There can be examples where different blocks of method 7000 can be combined into a single block or performed simultaneously, and/or where the sequence of such blocks can be changed. In some examples, some of the blocks of method 7000 can be optional. There can also be examples where method 7000 can comprise further or different blocks. As an example, method 7000 can comprise another block for coupling a golf club shaft to the golf club head. Other variations can be implemented for method 9000 without departing from the scope of the present disclosure.

Although the golf club heads with deflection structures and related methods herein have been described with reference to specific embodiments, various changes may be made without departing from the spirit or scope of the present disclosure. Additional examples have been given in the foregoing description. Other permutations of the different embodiments having one or more of the features of the various figures are likewise contemplated. Accordingly, the disclosure herein is intended to be illustrative and is not intended to be limiting. It is intended that the scope of this application shall be limited only to the extent required by the appended claims.

The golf club heads with deflection structures and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with driver-type golf clubs, fairway-wood-type golf clubs, and hybrid-type golf clubs, the apparatus, systems, methods, and articles of manufacture described herein may be applicable to other types of golf club such as, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:
- a crown;
- a sole;
- a head front end comprising a strikeplate and a leading edge;
- a head rear end;
- a shaft axis defining a shaft axis plane; and
- a deflector comprising:
  - a deflector perimeter comprising:
    - a deflector front edge adjacent to the head front end, wherein the deflector front edge is located forward of the shaft axis plane in order to directly expose the deflector to impact stresses upon impact with a golf ball;
    - a deflector heel edge;
    - a deflector toe edge; and
    - a deflector rear edge opposite the deflector front edge; and
  - a wave surface extended from the deflector front edge to the deflector rear edge, the wave surface comprising a plurality of external wave troughs defining external wave crests on an exterior of the golf club head with each of the external wave troughs including opposing outer wave sides within and surrounded by the deflector perimeter, wherein the plurality of external wave troughs comprises a forwardmost external wave trough that extends to the deflector heel edge and the deflector toe edge.

2. The golf club head of claim 1, wherein:
- a leading edge vertical plane intersects the leading edge and is parallel to the shaft axis plane;
- the strikeplate comprises a strikeplate thickness; and
- a deflector front offset, measured from the leading edge vertical plane to the deflector front plane and orthogonal to the shaft axis plane, is less than three times the strikeplate thickness.

3. The golf club head of claim 2, wherein:
- if the golf club head comprises one of a fairway-wood-type head or a hybrid-type head:
  - the deflector front offset is up to approximately 7.5 mm;
- and
- if the golf club head comprises a driver-type head:
  - the deflector front offset is up to approximately 13.5 mm.

4. The golf club head of claim 2, wherein:
- if the golf club head comprises one of the fairway-wood-type head or the hybrid-type head:
  - the strikeplate thickness is approximately 1.2 mm to approximately 2.5 mm;
- and
- if the golf club head comprises the driver-type head:
  - the strikeplate thickness is approximately 1.9 mm to approximately 4.5 mm.

5. The golf club head of claim 1, wherein the wave surface comprises a substantially sinusoidal wave shape.

6. The golf club head of claim 1, wherein the wave surface further comprises a wavelength measured in a front-rear direction with respect to the head front end and the head rear end, wherein the wavelength of the wave surface is approximately 2.5 mm to approximately 5.1 mm.

7. The golf club head of claim 1, wherein:
- a deflector rear plane intersects the deflector rear edge and is parallel to the shaft axis plane; and
- a deflector depth, measured from the deflector front plane to the deflector rear plane and orthogonal to the shaft axis plane, is less than approximately 12.5 mm.

8. The golf club head of claim 1, wherein:
- the deflector rear edge is located forward of the shaft axis plane.

9. The golf club head of claim 1, wherein a leading edge horizontal plane intersects the leading edge of the head front end and is orthogonal to the shaft axis plane, and one or more of the plurality of wave crests are located below the leading edge horizontal plane.

10. The golf club head of claim 9, wherein each of the plurality of wave crests are located below the leading edge horizontal plane.

11. The golf club head of claim 1, wherein:
- the wave surface comprises:
  - an inner wave side facing an interior of the golf club head;
  - an outer wave side comprising the plurality of external wave troughs and external wave crests on an exterior of the golf club head; and
  - a wave surface thickness of approximately 0.5 mm to approximately 2 mm from the inner wave side to the outer wave side.

12. The golf club head of claim 11, wherein:
- the wave surface thickness is thinner than a sole thickness of the sole.

13. The golf club head of claim 1, wherein the deflector perimeter is substantially trapezoidal.

14. The golf club head of claim 1, wherein the plurality of external wave troughs of the wave surface comprise a wave height of approximately 2.5 mm to approximately 5 mm.

15. A golf club head comprising:
- a crown;
- a sole;
- a head front end comprising a strikeplate and a leading edge;
- a head rear end;
- a shaft axis defining a shaft axis plane; and
- a deflector comprising:
  - a deflector perimeter comprising:
    - a deflector front edge adjacent to the head front end;
    - a deflector heel edge;
    - a deflector toe edge; and
    - a deflector rear edge opposite the deflector front edge, wherein the deflector front edge and the deflector rear edge are located forward of the shaft axis plane; and a wave surface extended from the deflector front edge to the deflector rear edge, the wave surface comprising a plurality of external wave troughs defining external wave crests on an exterior of the golf club head with each of the external wave troughs including opposing outer wave sides within and surrounded by the deflector perimeter, wherein the plurality of external wave troughs comprises a forwardmost external wave trough that extends to the deflector heel edge and the deflector toe edge.

16. The golf club head of claim 15, wherein:

a leading edge vertical plane intersects the leading edge and is parallel to the shaft axis plane;

the strikeplate comprises a strikeplate thickness; and a deflector front offset, measured from the leading edge vertical plane to the deflector front plane and orthogonal to the shaft axis plane, is less than three times the strikeplate thickness.

17. The golf club head of claim 16, wherein:

if the golf club head comprises one of a fairway-wood-type head or a hybrid-type head:

the deflector front offset is up to approximately 7.5 mm;

and if the golf club head comprises a driver-type head:

the deflector front offset is up to approximately 13.5 mm.

18. The golf club head of claim 16, wherein:

if the golf club head comprises one of the fairway-wood-type head or the hybrid-type head:

the strikeplate thickness is approximately 1.2 mm to approximately 2.5 mm;

and if the golf club head comprises the driver-type head:

the strikeplate thickness is approximately 1.9 mm to approximately 4.5 mm.

19. The golf club head of claim 15, wherein the wave surface comprises a substantially sinusoidal wave shape.

20. The golf club head of claim 15, wherein the wave surface further comprises a wavelength measured in a front-rear direction with respect to the head front end and the head rear end, wherein the wavelength of the wave surface is approximately 2.5 mm to approximately 5.1 mm.

* * * * *